US006976599B1

(12) United States Patent
Rivera et al.

(10) Patent No.: US 6,976,599 B1
(45) Date of Patent: Dec. 20, 2005

(54) MULTI-RAIL DUAL HOISTING CRANE

(75) Inventors: Rafael Rivera, Magnolia, NJ (US); Christopher Clemmer, Allentown, PA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 113 days.

(21) Appl. No.: 10/758,557

(22) Filed: Jan. 16, 2004

Related U.S. Application Data

(60) Provisional application No. 60/506,463, filed on Sep. 26, 2003.

(51) Int. Cl.[7] ..... B66C 19/00

(52) U.S. Cl. ..... 212/325; 212/312

(58) Field of Search ..... 104/35, 89, 99, 104/130.6; 212/312, 316, 324, 325, 315

(56) References Cited

U.S. PATENT DOCUMENTS

| | | | | |
|---|---|---|---|---|
| 1,111,100 | A * | 9/1914 | Sawyer | 212/286 |
| 1,327,071 | A * | 1/1920 | Taylor | 104/91 |
| 1,481,404 | A * | 1/1924 | Wright | 414/348 |
| 3,735,709 | A * | 5/1973 | Matsumoto et al. | 104/130.06 |
| 4,750,429 | A * | 6/1988 | Mordaunt et al. | 104/98 |

* cited by examiner

*Primary Examiner*—Thomas J. Brahan
(74) *Attorney, Agent, or Firm*—Jacob Shuster

(57) ABSTRACT

Containers are respectively loaded onto and delivered from two trolleys of a single crane at pick-up and delivery locations by guided travel along a fixed travel path on a boom between the delivery location at one end of the boom and a central structure of the crane with a platform positioned thereon having a pair of parallel spaced track paths. Lateral movement of the platform alternatively aligns one of the parallel track paths with the fixed travel path to accommodate transfer of the trolleys along such fixed travel path and either one of the track paths on the platform between the pick-up and delivery locations.

6 Claims, 4 Drawing Sheets

FIG. 3
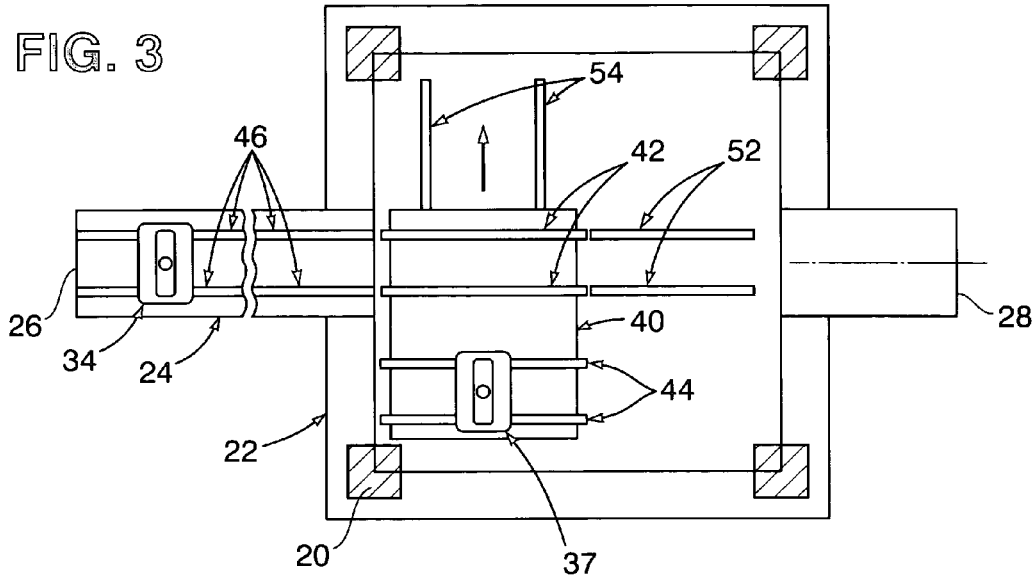
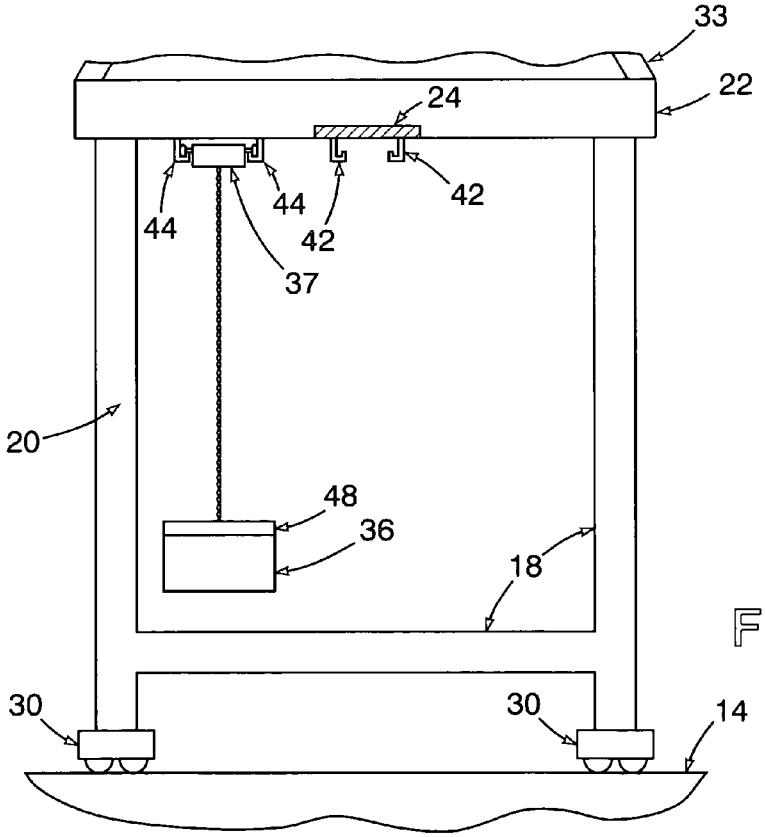
FIG. 4

FIG. 5
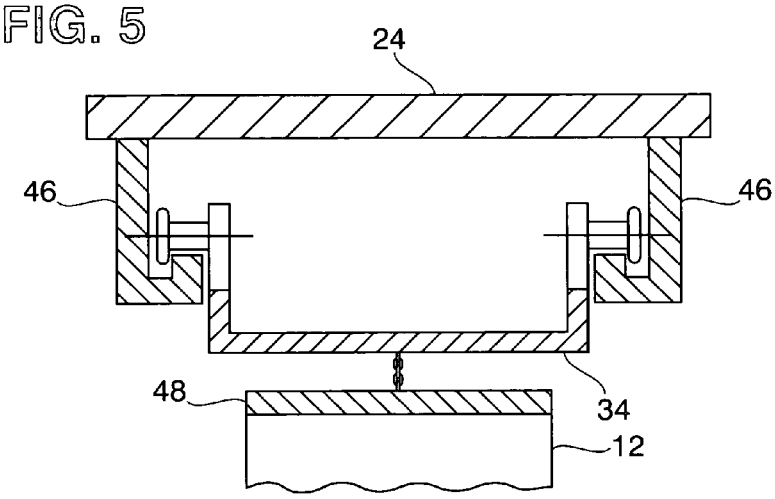
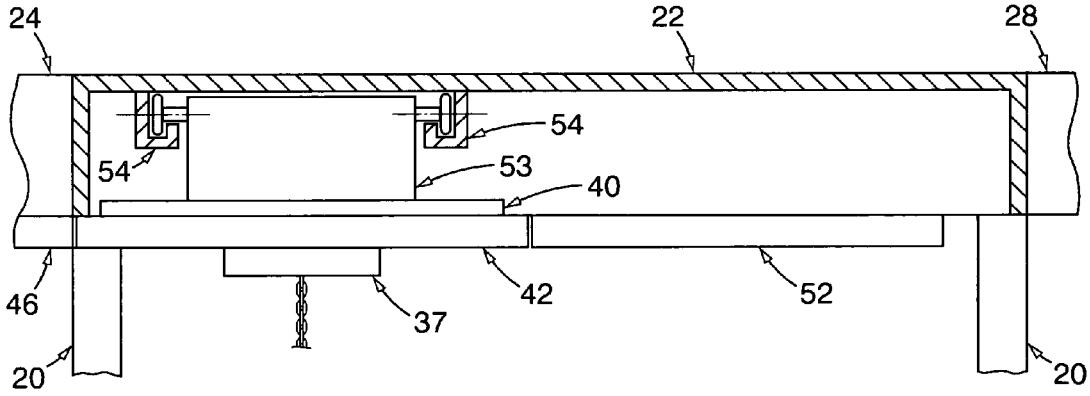
FIG. 6

MULTI-RAIL DUAL HOISTING CRANE

CROSS-REFERENCE TO RELATED APPLICATION

This application claims the benefit of U.S. Provisional Application No. 60/506,463 filed Sep. 26, 2003, entitled "Multi-Rail Dual Hoisting Crane", incorporated herein by reference.

STATEMENT OF GOVERNMENT INTEREST

The invention described herein may be manufactured and used by or for the Government of the United States of America for governmental purposes without the payment of any royalties thereon or therefore.

The present invention relates generally to the transport of containers on a crane between land-based delivery and dockside sea vessel pick-up locations.

BACKGROUND OF THE INVENTION

Current facilities for transport of containers between land and ships involve large marine terminal cranes, which typically embody one trolley traveling along the length of a boom for pick-up and delivery of the containers. While such cranes may be adequate for low demand at small scale sea ports, at larger ports such cranes are a disrupting bottleneck to terminal activities, which call for additional equipment and cranes to avoid delays in port traffic and container transfer. It is therefore an important object of the present invention to provide for a more efficient less costly and less time-consuming transfer of containers from land-based trucks to dock-side ships through the aforementioned type of marine terminal crane.

SUMMARY OF THE INVENTION

The present invention is related to the invention covered in a related copending application Ser. No. 10/758,560, filed Jan. 16, 2004. The inventions disclosed in both applications involve use of a single crane through which repeated cycles of two simultaneously functioning trolleys may be moved along fixed paths on a boom. Pursuant to the present invention each of the trolleys is also moved along one of two parallel spaced straight rail paths on a platform that is laterally displaced in a direction perpendicular to a fixed path on the boom for either straight-through transit of the trolley or lateral transfer thereof between fixed boom rail paths so as to accommodate transfer of each trolley between the boom paths and either one of two loading and unloading positions under a central crane structure. One of the trolleys may thereby be cyclically emptied or loaded from one end of the boom, while the other trolley is either loaded with a container or emptied at one of the two positions underlying the platform.

BRIEF DESCRIPTION OF DRAWING

A more complete appreciation of the invention and many of its attendant advantages will be readily appreciated as the same becomes better understood by reference to the following detailed description when considered in connection with the accompanying drawing wherein:

FIG. 3 is a section view taken substantially through a plane indicated by section line 3—3 in FIG. 1;

FIGS. 4, 5 and 6 are section views taken substantially through planes indicated by section lines 4—4, 5—5 and 6—6 in FIG. 2, and;

DETAILED DESCRIPTION OF PREFERRED EMBODIMENT

Figure 1:
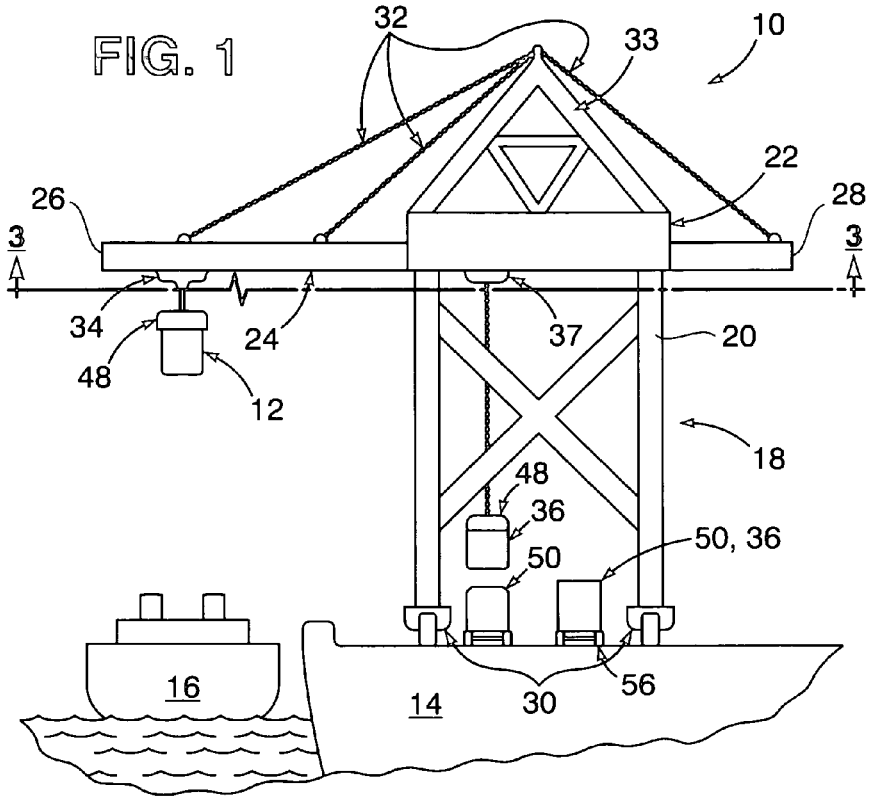
FIG. 1 is a side elevation view of a crane constructed in accordance with one embodiment of the present invention.
Figure 2:
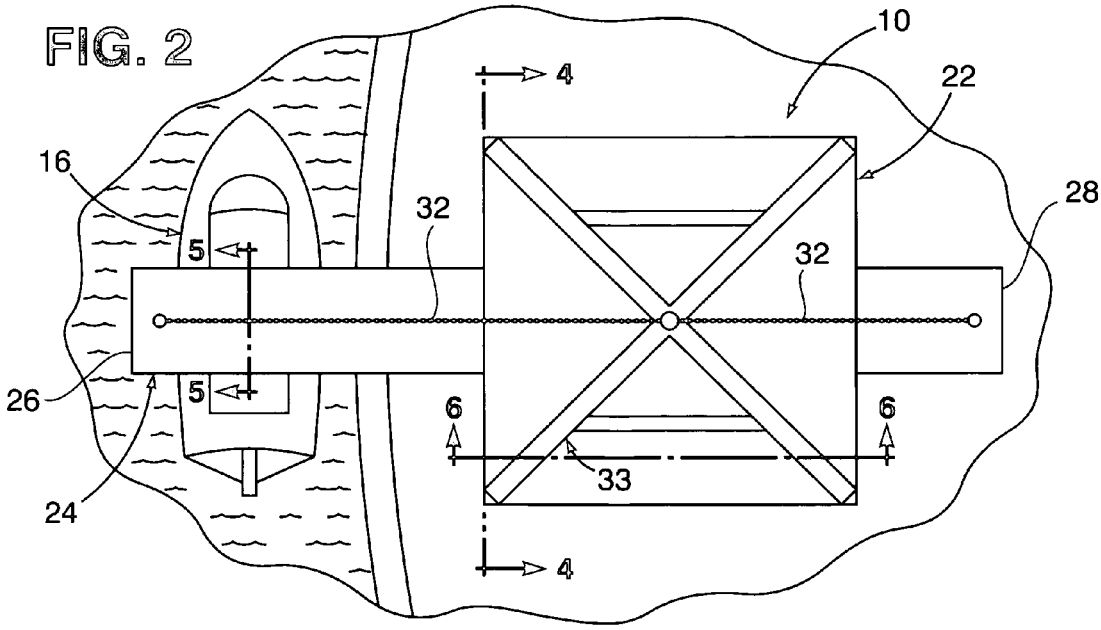
FIG. 2 is a top plan view of the crane illustrated in FIG. 1.

Referring now to the drawing in detail, FIGS. 1 and 2 illustrate a multi-rail crane 10 adapted to be moved to a position for transfer of standard containers, such as a container 12 between pick-up and delivery locations respectively disposed on a land-based pier 14 and dockside sea vessels 16. The crane 10 has a support frame 18 embodying four vertical gantry legs 20 interconnected in spaced relation to each other so as to support on their upper ends a rectangular central structure 22 in a horizontal position. An elongated boom 24 extends horizontally from the central structure 22 over the sea vessel 16. Opposite ends 26 and 28 of the boom 24 are spaced from the central structure 22 by different amounts. The boom end 26 is spaced a sufficient distance from the central structure 22 so as to accommodate container delivery thereat onto the sea vessel 16 when the crane 10 is appropriately positioned on the pier 14 by motorized wheel assemblies 30 at the lower ends of the crane gantry legs 20. Support cables 32 attached to the top of an anchor 33 fixed to the central structure 22 maintains the boom 24 in its horizontal position by connection of the lower ends of the cables 32 to the boom 24 adjacent to its opposite ends 26 and 28.

The container 12 is suspended below the boom 24 by a spreader bar 48 from one trolley 34 as shown in FIG. 1 so as to undergo travel along a fixed rail path on the underside of the boom 24 between its end 26 and the central structure 22 as shown by dotted line in FIG. 3. A second container 36 is suspended by a spreader bar 48 below the central structure 22 from a second trolley 37 mounted below a platform 40 as shown in FIGS. 3 and 6 performing a lateral switching function as hereinafter explained.

The platform 40 as shown in FIGS. 3 and 6 is mounted below the central structure 22 on a trolley 53 supported on a pair of tracks 54, fixed to the underside of the structure 22 to expose the platform 40 below the structure 22. The platform 40 is moved laterally relative to the boom 24 on the underside of the central structure 22 by the trolley 53 attached to the platform 40. Such lateral movement of the platform 40 by its trolley 53 is guided along the tracks 54 mounted on the central structure 22. Two pairs of tracks 42 and 44 are formed on the underside of the platform 40 as shown in FIG. 3 to establish a pair of parallel spaced straight trolley travel paths which are alternatively aligned, by lateral movement of the platform 40 along the tracks 54, with a fixed travel path established along the underside of the boom 24 by aligned boom tracks 46 fixed thereto and the tracks 52 fixed to the central structure 22. The trolleys 34 and 37 are respectively guided for movement along the tracks 46 on the boom 24, the tracks 42 or 44 on the platform 40 and the fixed tracks 52 on the central structure 22 as shown in FIGS. 3, 4 and 5. The spreader bars 48 respectively suspend the containers 12 and 36 from the trolleys 34 and 37. When either one of the platform tracks 42 and 44 is aligned with the fixed boom tracks 46 as shown in FIG. 3, the trolley 34 or 37 with its spreader bar 48 may be switched between the boom tracks 46 and the platform tracks 42 or 44 so as to thereby transfer the container 12 or 36 between the underside fixed travel paths on the boom 24 and tracks positioned on the central structure 22 as hereinafter explained.

The multi-rail crane 10 as hereinbefore described utilizes the two trolleys 34 and 37 in alternating fashion on a single set of the tracks 46 on the boom 24 which is of standard size and weight. The platform trolley 53 provides motorized switching of the platform 40 to provide selective use of the two sets of tracks 42 and 44 thereon laterally spaced from each other in a side by side fashion. The two trolleys 34 and 37 may thereby be operated in unison to provide for more efficient crane delivery. While one of the trolleys 34 or 37 is at a land-side location under the central structure 22 for pick-up of the container 12 or 36, the other of the trolleys 34 or 37 may be at the boom end 26 for dropping off the container 12 or 36 onto the cargo hold of the ship 16. The emptied trolley 34 or 37 then rotates the spreader bar 48 suspended therefrom by 90° in a counter-clockwise direction and moves back to the switching platform 40 onto the platform tracks 44. Once the emptied trolley 34 or 37 is on the platform 40, platform switching is effected by lateral movement of the platform trolley 53 on the platform 40 as shown in FIG. 6 along tracks 54 on the underside of the central structure 22, to the position shown in FIG. 3, with the other pair of the platform tracks 42 aligned with the tracks 52 on the central structure 22. The other fully loaded trolley 34 or 37 then has a cleared main trail path toward the boom end 26 along the tracks 52, 42 and 46 for delivery of the container 12 or 36 to the ship 16. After the loaded trolley 34 or 37 passes the platform 40, the emptied trolley 34 or 37 laterally spaced from such main rail path rotates the spreader bar 48 or 49 suspended therefrom clockwise by 90° and proceeds to pick up a container 36. Trolleys and containers would then be positioned as shown in FIGS. 1, 3 and 4. The trolley 34 by delivery of the container 12 at the boom end 26 is emptied and begins its movement back toward the platform 40, while the spreader bar 48 suspended therefrom is again rotated 90° counter-clockwise, so that the trolley 34 may easily pass by the loaded trolley 37 along the platform tracks 42, without stopping on the platform 40 to await switching, and continue to move inland onto the fixed pair of tracks 52 to thereby facilitate movement of trucks 50 along two traffic lanes as shown in FIG. 1 below the crane 10. Since there are two distinct locations for container transfer below the central structure 22 of the crane 10, utilizing the two lanes of traffic for the trucks 50 decreases truck waiting time and increases truck transfer efficiency. Once the trolley 34 has been moved onto the fixed tracks 52, it rotates the spreader bar 48 suspended therefrom by 90° clockwise before the platform 40 is laterally switched back to its position aligning the platform tracks 44 with the boom tracks 46 so as to allow the loaded trolley 37 to deliver the container 36 to the ship 16. The trolleys 34 and 37 are then back in their original position from which a complete transfer process may be repeated.

Figure 7A:
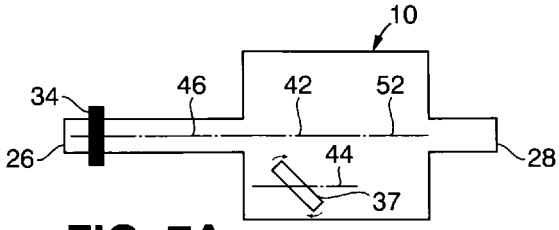
FIGS. 7A, 7B, 7C, 7D, 7E, 7F and 7G are simplified bottom views of the crane shown in FIGS. 1–6, diagramming a container transfer process associated therewith.
Figure 7B:
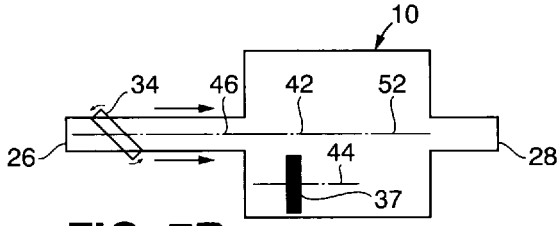
Figure 7C:
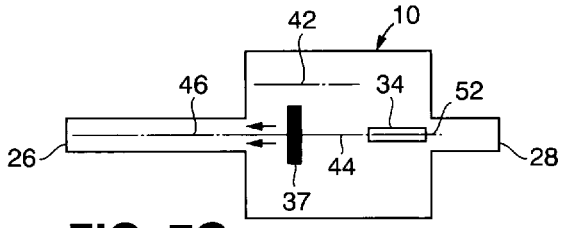
Figure 7D:
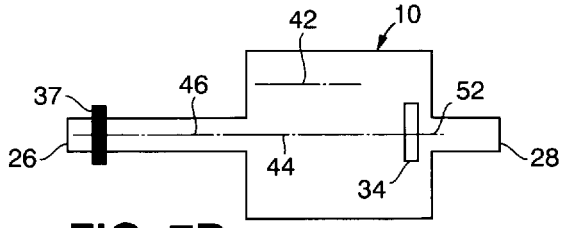
Figure 7E:
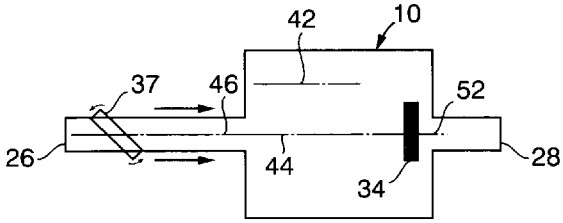
Figure 7F:
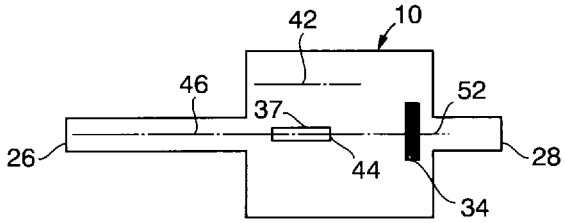
Figure 7G:
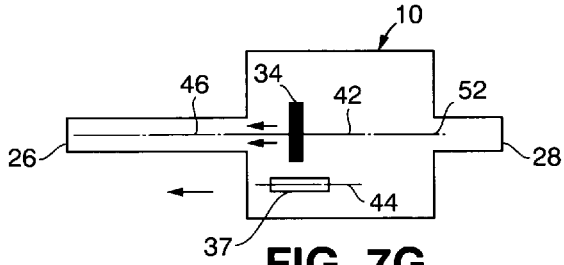

FIGS. 7A, 7B, 7C, 7D, 7E, 7F and 7G summarize the container transfer process hereinbefore referred to by diagrammatically showing one main rail path established on the crane 10 by the fixed pairs of the tracks 46 and 52 in alignment with one of the pairs of switchable platform tracks 42 and 44. As diagrammed in FIG. 7A the container 12 suspended from the trolley 34 for example is positioned on the fixed crane rail path established by the boom tracks 46 and located adjacent the boom end 26 for delivery by lowering thereof onto the ship 16, while the other trolley 37 is being rotated clockwise 90° before picking up the container 36 from the truck 50 in one of the truck lanes as shown in FIG. 1. FIG. 7A accordingly diagrams the beginning of the crane transfer process, followed by the next process step diagrammed in FIG. 7B showing the emptied trolley 34 returning along rail tracks 46 and 42 toward tracks 52 while rotating counter-clockwise 90°. The other trolley 37 is then lifting the container 36 from a truck 50. During the next transfer process step as diagrammed in FIG. 7C, the emptied trolley 34 has traversed to the fixed tracks 52 while the tracks 44 with the container laden trolley 37 thereon have subsequently switched into alignment with the fixed boom trail path tracks 46 for ship delivery of the container. In FIG. 7D, the empty trolley 34 has rotated clockwise 90° and awaits pick up of another container from the inland truck lane 56 shown in FIG. 1, while the trolley 37 has reached boom end 26 for delivery of the container 36. In FIG. 7E, the emptied trolley 37 is being rotated counter-clockwise 90° while returning along the boom tracks 46 toward the tracks 44 on the switching platform 40 aligned therewith. A new container is being lifted by the trolley 34 from the truck 50 in the inland truck lane 56. During the next transfer process step diagrammed in FIG. 7F, the emptied trolley 37 on the platform tracks 44 is ready for lateral track switching. In FIG. 7G, the tracks 44 with the empty trolley 37 and the tracks 42 have been laterally displaced to bring the tracks 42 into alignment with the fixed trail path tracks 46 and 52, and the other container laden trolley 34 then undergoes movement along the path of the tracks 52, 42 and 46 toward the ship delivery location at the boom end 26 for container delivery to the ship 16. The foregoing described container transfer process is then repeated.

Obviously, other modifications and variations of the present invention may be possible in light of the foregoing teachings. It is therefore to be understood that within the scope of the appended claims the invention may be practiced otherwise than as specifically described. application.

What is claimed is:

1. A crane for cyclic transfer of two containers between pick-up and delivery locations, comprising: an elongated boom; frame means for support of the boom in alignment with a fixed travel path established on the crane; a platform having a pair of parallel spaced straight track paths established thereon; mounting means supporting the platform on the frame means for accommodating lateral displacement of said pair of the parallel spaced straight track paths relative to the fixed travel path; a pair of trolleys onto which the two containers are respectively loaded at the pick-up location unloaded at the delivery location; and spreader means for respectively suspending from said trolleys to which the two containers to accommodate transfer thereof between the fixed travel path and either one of said pair of the parallel spaced straight track paths on the platform.

2. The crane as defined in claim 1, wherein said frame means includes: a central structure on which the platform mounting means is supported; gantry legs extending from the central structure and having lower ends connected to wheeled trucks through which the crane is movably positioned to establish an operative relationship wherein the fixed travel path and one of said pair of the track paths on the platform leads to either one of two truck transfer lanes below the central structure of the crane as the pick-up or delivery location.

3. The crane as defined in claim 1, wherein said lateral displacement of the pair of parallel spaced straight track paths is in a perpendicular direction relative to the fixed travel path.

4. A crane through which two trolleys transfer loads between pick-up and delivery locations, comprising: a frame; an elongated boom fixedly mounted on the frame; a platform; track means respectively mounted on the frame, the boom and the platform for guiding travel of the trolleys along a fixed travel path on the frame and the boom in alignment with a selected one of a pair of parallel spaced straight travel paths on the platform; and means mounting the platform on the frame for guiding lateral displacement of thereof with said pair of the parallel spaced straight travel paths into and out of said alignment with the fixed travel path on the boom to accommodate transfer of said two trolleys between the fixed travel path on the frame and the boom and the one of the parallel spaced straight travel paths on the platform in alignment therewith.

5. The crane as defined in claim 4, wherein said boom projects from the frame to one of the pick-up and delivery locations overlying a ship, while one of said pair of the parallel spaced straight travel paths on the platform leads to said delivery and pick-up locations under the crane when in alignment with the fixed travel path.

6. The crane as defined in claim 5, wherein said lateral displacement of the pair of parallel spaced straight track paths is in a perpendicular direction relative to the fixed travel path.

* * * * *